United States Patent [19]

Liou et al.

[11] 4,441,756

[45] Apr. 10, 1984

[54] LOUNGE CHAIR WITH IMPROVED ARM RESTS

[75] Inventors: Tony Liou, Tai Pei, Taiwan; Richard Wang, Fair Lawn, N.J.

[73] Assignee: Collins Company, Ltd., Secaucus, N.J.

[21] Appl. No.: 344,170

[22] Filed: Jan. 29, 1982

[51] Int. Cl.[3] ..... A47C 4/00; A47C 5/10; F16B 12/40

[52] U.S. Cl. ..... 297/39; 297/35; 297/421; 403/390

[58] Field of Search ..... 297/35, 39, 40, 41, 297/420, 421, 418, 354; 403/388, 390, 391, 399, 161, 162

[56] References Cited

U.S. PATENT DOCUMENTS

| | | | |
|---|---|---|---|
| 2,101,317 | 12/1937 | Lemieux | 403/391 X |
| 2,467,909 | 4/1949 | Rechler | 297/39 X |
| 2,600,374 | 6/1952 | O'Neill | 297/35 X |
| 2,681,099 | 6/1954 | Vallone | 297/31 |
| 2,957,516 | 10/1960 | Kubisz | 297/39 X |
| 3,046,040 | 7/1962 | Luper | 403/388 |
| 3,047,334 | 7/1962 | Vanderminden | 297/39 |
| 4,252,371 | 2/1981 | Lehnen | 297/421 |

FOREIGN PATENT DOCUMENTS

| | | | |
|---|---|---|---|
| 548903 | 7/1956 | Belgium | 297/39 |
| 899342 | 9/1944 | France | 403/391 X |
| 1056487 | 5/1954 | France | 297/39 |

*Primary Examiner*—William E. Lyddane
*Assistant Examiner*—Peter R. Brown
*Attorney, Agent, or Firm*—Bauer & Amer

[57] ABSTRACT

A lounge chair with arm rests, of the type patented in U.S. Pat. No. 4,252,371, in which the arm rest supports partake of pivotal traversing movements and are arranged to do so against a bearing surface which effectively eliminates wobble or other undesirable degrees of movement other than that in the plane of the pivotal traverses.

1 Claim, 7 Drawing Figures

LOUNGE CHAIR WITH IMPROVED ARM RESTS

The present invention relates generally to an improved lounge chair, in which more particularly, the improvements reside in the pivotal mounting of the arm rests for the lounge chair.

As understood, a lounge chair having a multipositionable back rest can, for the further comfort of the user, also have arm rests but the supports for these arm rests must be mounted for pivotal traversing movement in order to allow for the changing positions of the back rest. The pivotal mountings for the arm rest supports are a source of problems, however, since the user, when rising from the chair, has a tendency to exert considerable force on the arm rests which, of course, is transferred to the referred to pivotal connections which, at best, are weak from a structural viewpoint.

A prior art effort to provide the pivotal connections of the arm rests of a lounge chair with structural stability is exemplified by U.S. Pat. No. 4,252,371, in which a U-shaped pivotally mounted member supports the arm rests and resists the forces that are applied to it to the corresponding extent that the U-shape resists being bent out of this shape. In this way, the strain of the applied forces is resisted by the construction material of the U-shaped member, rather than being borne by the pivotal connections.

While somewhat effective, the patented U-shaped member above noted is not entirely satisfactory. For example, to obviate the possibility that the U-shaped member will detract from the comfort in using the lounge chair, said member must be comparatively large in size and, consequently, is unwieldly.

Broadly, it is an object of the present invention to provide pivotal connections for the arm rests of a lounge chair that are significantly improved in their sturdiness and which overcome the foregoing and other shortcomings of the prior art. Specifically, it is an object to effectively confine the arm rest supports to the plane of the pivotal traverses thereof, thereby obviating wobble and structural instability in the pivotal mountings thereof.

As already noted, the within improvements are embodied in a lounge chair of the type having a horizontally oriented seat and a back rest pivotally connected thereto so as to assume a selected back-supporting angular orientation to said seat, and also having arm rests in operative arm-supporting positions on opposite sides of the seat. In such a lounge chair, an improved means for mounting each arm rest in its operative position, which demonstrates objects and advantages of the present invention, includes an arm rest support member pivotally connected to a side of the seat in supporting relation beneath the front of a cooperating armrest, while at its rear the arm rest is connected to the back rest so as to be mounted in spanning relation between the back rest and arm rest support member and, in this way, be operatively arranged to partake of movement in unison with the pivotal traversing movement that occurs during the positioning of the back rest. Completing the mounting for each arm rest support is a member stationarily connected in an interposed position between said arm rest support member and the side of the seat. This interposed member presents a circular connected or bearing surface for the arm rest support member in any assumed position of pivotal traversing movement thereof, whereby said contact by the arm rest support member against this bearing surface is along a diametrical line of a sufficient extent that is effective to obviate any wobble in the pivotally mounted arm rest support member.

The above description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
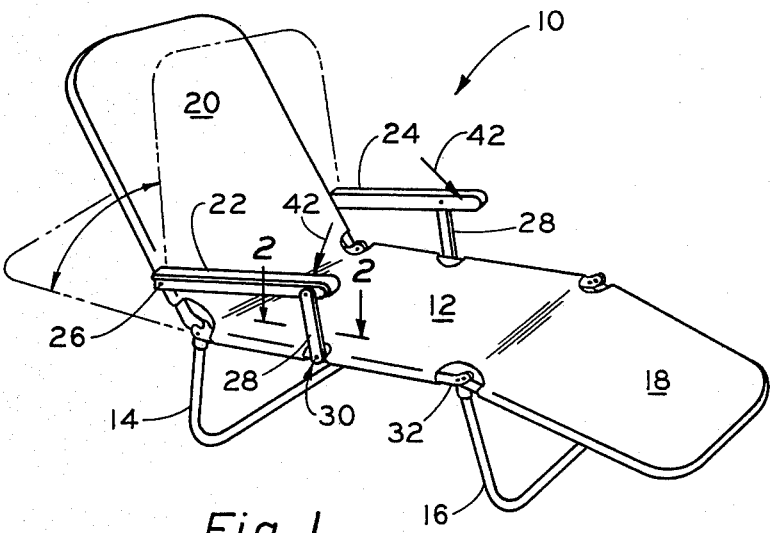
Fig. 1 PRIOR ART
FIG. 1 is a perspective view of a prior art lounge chair with arm rests and, thus, of a lounge chair in the classification to which the within improvements are applied.
Figure 3:
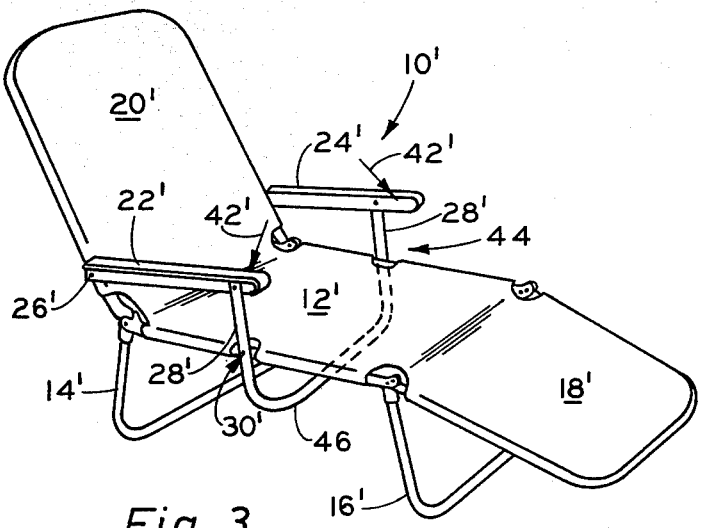
Fig. 3 PRIOR ART
Figure 4:
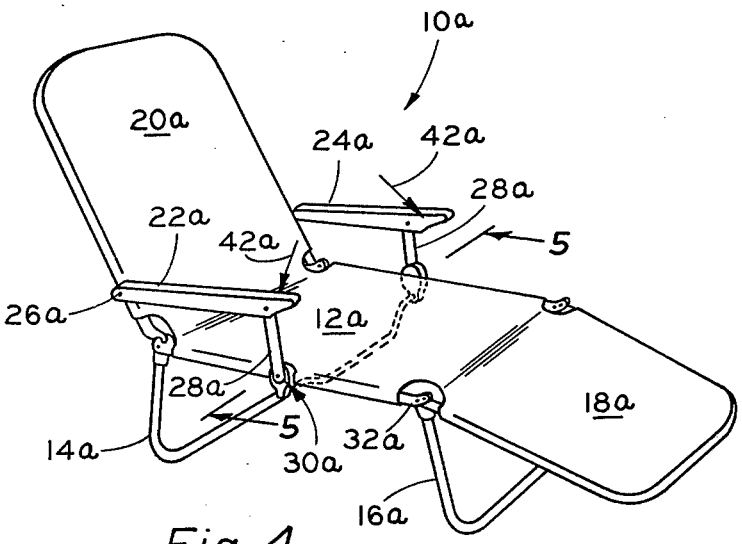
Figure 5:
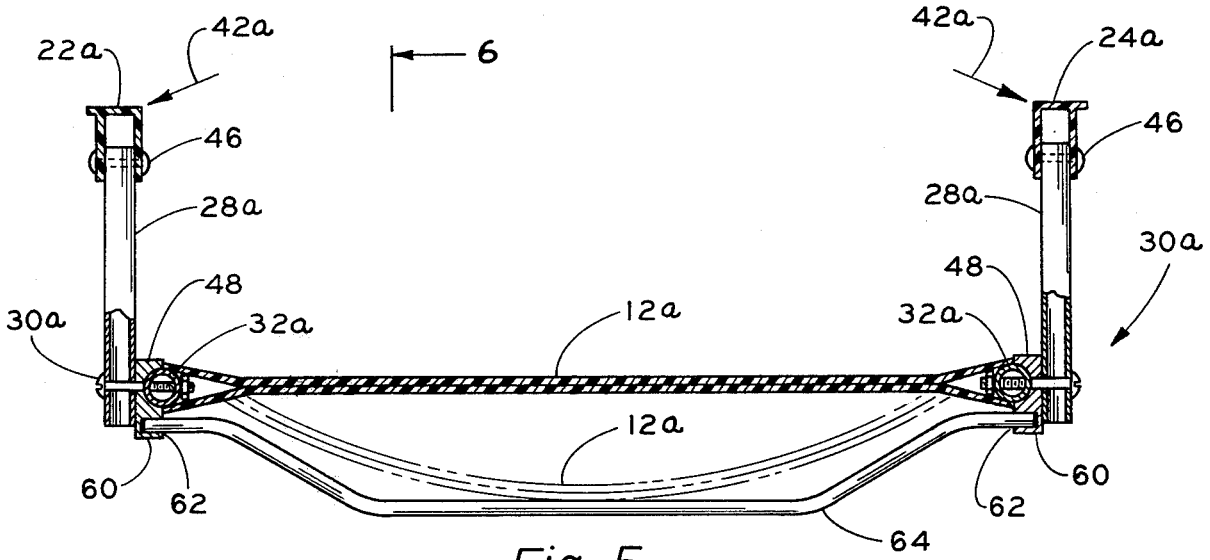
Figure 6:
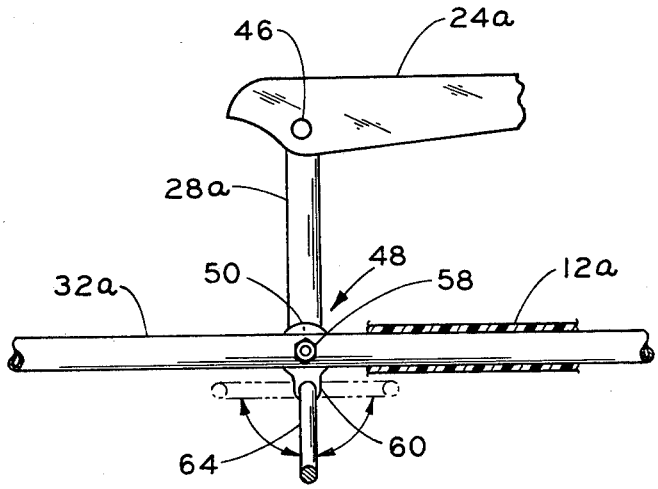
Figure 7:
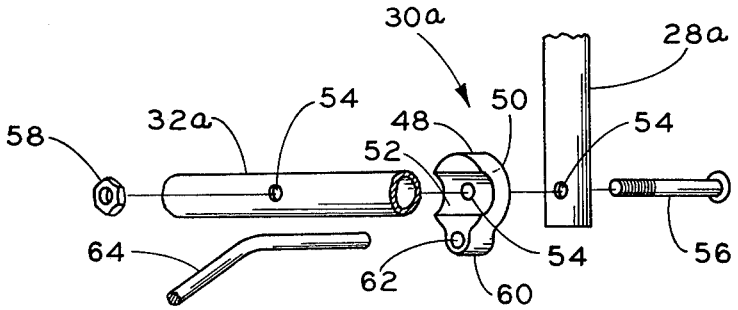

FIG. 3, like FIG. 1, is a perspective view of another prior art lounge chair with arm rests in which improvements have been added to obviate the difficulties experienced with the pivotal connection of the arm rests;

The remaining figures relate to a lounge chair according to the present invention in which, more particularly, improvements are applied to obviate any difficulties with the pivotal connection of the arm rests, but in a more advantageous and effective manner than that used in the lounge chair of FIG. 3. More particularly, FIG. 4 is a perspective view of the within improved lounge chair with arm rests according to the present invention;

FIG. 5 is a front elevational view, in section taken along lines 5—5 of FIG. 4, showing structural details of the mounting for the arm rests;

FIG. 6 is a side elevational view, on an enlarged scale, taken along line 6—6 of FIG. 5, showing further structural details; and FIG. 7 is a partial view in exploded perspective, illustrating the individual structural components of the pivotal mounting of the within improved arm rests.

Figure 2:
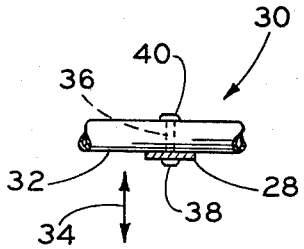
Fig. 2 PRIOR ART
FIG. 2 is a partial plan view taken in section along lines 2—2 of FIG. 1, showing details of the front pivotal mounting for one of the arm rests that is the source of most problems involving the sturdiness thereof during use of the chair.

The improvements of the present invention are applied to a lounge chair 10 of the type having a horizontally oriented seat 12 supported at opposite ends on U-shaped feet 14, 16, and further including a foot rest and a back rest 18 and 20, respectively, pivotally connected at opposite ends to the seat 12. Lounge chair 10 is further of the type having identically constructed arm rests 22 and 24, each pivotally connected at one end, as at 26, to the back rest 20 and at its opposite end connected to a depending support member 28 pivotally connected, as at 30, to a cooperating tubular side 32 of the seat 12. As perhaps can best be appreciated from FIG. 2, the pivotal connection 30 established between the member 28 and the tubular side 32 is vulnerable to wobble, i.e. inadvertent movements in the directions 34, since the pivotal connection for each arm rest is provided only by a bolt 36 disposed through the tubular member 32 and held in place at opposite ends by a bolt head 38 and a nut 40. That is, and as best illustrated in FIG. 1, any force 42 exerted on an arm rest such as arm rest 24, which typically happens when the occupant rises from the lounge chair 10, will strain the pivotal connection 30 and inadvertently produce the wobble movements 34 in said pivotal connection.

To essentially obviate the wobble or weakness in the pivotal connection 30 of the lounge chair 10, there has already been provided an improved version thereof, as shown in FIG. 3. Since the lounge chair of FIG. 3 is constructed with essentially the same structural components as already described in connection with FIG. 1, the description thereof will not be repeated and said duplicated structural features will be designated by the same but primed reference numerals. What essentially distinguishes lounge chair 10' of FIG. 3 from lounge chair 10 of FIG. 1 is that the former has as a support for the arm rests 22' and 24' a U-shaped member 44 as a substitute for the supports 28 of FIG. 1. It should be apparent that the same outward force 42' exerted on arm rest 24' is effectively resisted by the U-shaped member 44 because said member includes not only the equivalent of the length segments 28' but also the interconnecting length portion 46, which adds the needed structural strength to the length segments 28' to resist the force 42'. The prior art lounge chair 10' is exemplified by the chair described and illustrated in U.S. Pat. No. 4,252,371 issued on Feb. 24, 1981.

The within improved lounge chair also effectively obviates any wobble or movements transverse to the actual pivotal plane of the arm supports of the arm rests, and does so without the U-shaped member which is considered to be unwieldy. In an extreme backwardly disposed position of the back rest 20', in which it is almost horizontally oriented, the connecting leg 46 of the U-shape is, of course, projected from a clearance position into an adjacent position beneath the seat 12' and, thus, would adversely affect the comfort of the user unless it was far enough away from the bottom of the seat 12' so as to avoid being contacted with. It is, thus, necessary to size the U-shaped member 44 so that the cross leg 46 remains out of contact with, or sufficiently below the seat 12', in all positions of the back rest 20'. This invariably results in an unwieldy size in the U-shaped member 44.

As a more effective solution to the problem, there is provided in accordance with the present invention the version of a lounge chair more particularly illustrated in FIGS. 4–7, respectively. Here again, the referred to lounge chair has many structural features already described in connection with FIGS. 1 and 3 and for brevity's sake, the same structural features will not again be described but will be designated by the same reference numeral followed by the subscript "a." What distinguishes the lounge chair **10*a* of FIG. 4 from the previously described lounge chair is the improved manner in which the front arm rest support members 28*a* are pivotally mounted to the seat tubular members 32*a*. This improved mounting arrangement is more particularly illustrated in FIGS. 5, 6 and 7, to which figures reference should now be made. As already indicated, each of the arm rests 22*a* and 24*a* are identically constructed in that each is pivotally mounted at its forward end, as at 46, to each of the support members 28*a*, and said support members 28*a* are, in turn, pivotally connected, as at 30*a*, to a cooperating one of the tubular side members 32*a* of the seat 12*a***.

As is, perhaps, most readily understood from the exploded view of FIG. 7, each pivotal mounting **30*a* includes a member 48, which has an advantageous interposed position between each tubular side 32*a* and pivotally movable member 28*a*. On one side, member 48 presents a circular bearing surface 50, the purpose and function of which will soon be described in detail, and on its opposite side has a horizontally oriented groove 52 which, in size and shape, is readily adapted to receive therein the cylindrical shape of the tubular member 32*a*. Three aligned openings, individually and collectively designated 54, are provided in the components 32*a*, 48 and 28*a*, and projected therethrough is a bolt 56 which has a threaded end which is placed in threaded engagement with a nut 58 and which completes the assembly of the member 48 in a stationary condition in its interposed position between the tubular member 32*a* and the pivotally movable member 28*a***.

It will be understood, and it should be readily apparent from the drawings, that the bearing surface 50 of member 48 is generally circular in shape and, as a result, provides a line contact with the member **28*a* that extends the diameter of the circular shape 50. In a preferred commercial embodiment, this line contact is for approximately $1\frac{3}{8}$ inches and has been found to be effective in providing sufficient stability for the pivotal mounting 30*a* to prevent any wobble or movement transverse to the pivotal plane about the axis of the bolt 56. At this point in the description, it should be noted that because each tubular member 32*a* is seated in the groove 52, that there is no tendency of member 48 to be urged through rotation during the pivotal traversing movement of member 28*a* which, as already indicated, is in line contact with the bearing surface 50**.

To further prevent any inadvertent wobble or movements in the member **28*a* other than in the plane in which it partakes of pivotal traverses about the rotation axis of the bolt 56, each member 48 has a depending projection 60 with a blind drill hole 62. Rotatably disposed in each of the drill holes 62 are the opposite ends of a transversely oriented bar 64, all as is clearly illustrated in FIG. 5. That is, the in-use position of the bar 64 is one in which it is well below the plastic construction material of the seat 12*a* so that the position of movement of the seat under the weight of the user, as illustrated in phantom perspective in FIG. 5, still does not bring the seat into contact with the bar 64. However, when the chair 10*a* is folded into its storage condition, i.e. the condition in which the back rest 20*a* and foot rest 18*a* are folded back onto the seat 12*a*, the bar 64 is then rotated in either direction into a storage condition, as illustrated in phantom perspective in FIG. 6, in which it is in an out-of-the-way position adjacent to the seat 12*a***.

From the description provided, it should be readily appreciated, particularly from FIG. 5, that any force **42*a* exerted against any of the arm rests 22*a*, 24*a*, would be effectively resisted so as to obviate any outward movement of the supports 28*a* due to the diametrical line of physical contact that is established between the bearing surface 50 of each member 48 and its cooperating arm rest support member 28*a***.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. In a lounge chair of the type having a horizontally oriented seat and a back rest pivotally connected thereto so as to assume a selected back-supporting angular orientation to said seat and including arm rests in operative arm-supporting positions on opposite cylindrically-shaped sides of said seat, an improved means for mounting each said arm rest in said operative position thereof comprising an arm rest support member pivotally connected to a cylindrically-shaped side of said seat in supporting relation beneath the front of a cooperating arm rest, said arm rest being further connected at its opposite end to said backrest so as to be mounted in spanning relation between said back rest and arm rest support member and to operatively be arranged to partake of movement in unison with the pivotal traversing movement during the positioning of said back rest, a member having on one side a smooth circular contact surface and on an opposite side a semi-circular groove and a depending projection therefrom, said member being stationarily connected in an interposed position between said arm rest support member and said cylindrically-shaped side of said seat with said one side presenting a circular contacted surface for said arm rest support member in any assumed position of pivotal traversing movement thereof, whereby said contact by said arm rest support member against said surface is along a diametrical line of a sufficient extent that is effective to obviate any wobble in said pivotally mounted arm rest support member, and with said opposite side presenting said semi-circular groove for the seating thereof of said cylindrically-shaped side of said seat, to thereby obviate any possibility of rotative movement of said member in relation to said side of said seat that otherwise might result from pivotal movement of said arm rest support member against said opposite contacted surface of said member, and a bar-like member connected in spanning relation between said depending projections of said members to obviate any rotation between said depending projections of said members to obviate any rotation in said members about the longitudinal axis of said cylindrically-shaped sides of said seat.

* * * * *